US006379026B1

(12) United States Patent
Petrick

(10) Patent No.: US 6,379,026 B1
(45) Date of Patent: Apr. 30, 2002

(54) OBSTRUCTION LIGHTING SYSTEM

(76) Inventor: John T. Petrick, 11255 Osceola Dr., New Port Richey, FL (US) 34654

( * ) Notice: Subject to any disclaimer, the term of this patent is extended or adjusted under 35 U.S.C. 154(b) by 0 days.

(21) Appl. No.: 09/546,453

(22) Filed: Apr. 10, 2000

(51) Int. Cl.[7] ..... E21V 7/00

(52) U.S. Cl. ..... 362/347; 362/241; 362/231; 362/297; 362/346; 362/350; 362/800

(58) Field of Search ..... 362/231, 236, 362/241, 240, 247, 297, 293, 346, 153.1, 800, 224, 347, 341, 350

(56) References Cited

U.S. PATENT DOCUMENTS 3,634,675 A * 1/1972 Madsen ..... 362/153.1
4,236,193 A * 11/1980 Brandt ..... 362/241
4,517,631 A * 5/1985 Mullins ..... 362/297
4,956,759 A * 9/1990 Goldenberg et al. ..... 362/297
5,475,361 A * 12/1995 Curran et al. ..... 362/297
5,971,571 A * 10/1999 Rose ..... 362/347
6,168,294 B1 * 1/2001 Erni et al. ..... 362/293
6,227,682 B1 * 5/2001 Li ..... 362/293
6,234,648 B1 * 5/2001 Borner et al. ..... 362/800
6,238,066 B1 * 5/2001 Iwasaki ..... 362/347

* cited by examiner

*Primary Examiner*—Stephen Husar
*Assistant Examiner*—Peggy L Neils

(57) ABSTRACT

A lighting system includes a housing with a rear plate and upper and lower plates extending forwardly and with side plates extending forward coupling the upper and lower plats and with a cover essentially parallel with the rear plate to define a chamber there within. A light source is formed in a generally cylindrical configuration within the chamber. The light source has an axis within a horizontal plane. A reflector includes a lower component in a semi-circular configuration with an axis of rotation coextensive with the xis of the light source. The lower component also has upper ends terminating at the horizontal plane, a forward edge adjacent to the cover, and a rearward edge adjacent to the rear plate. The reflector has an upper component extending upwardly and forwardly from the rearward edge of the lower component in a parabolic configuration and terminating above and forwardly of the forward edge.

6 Claims, 3 Drawing Sheets

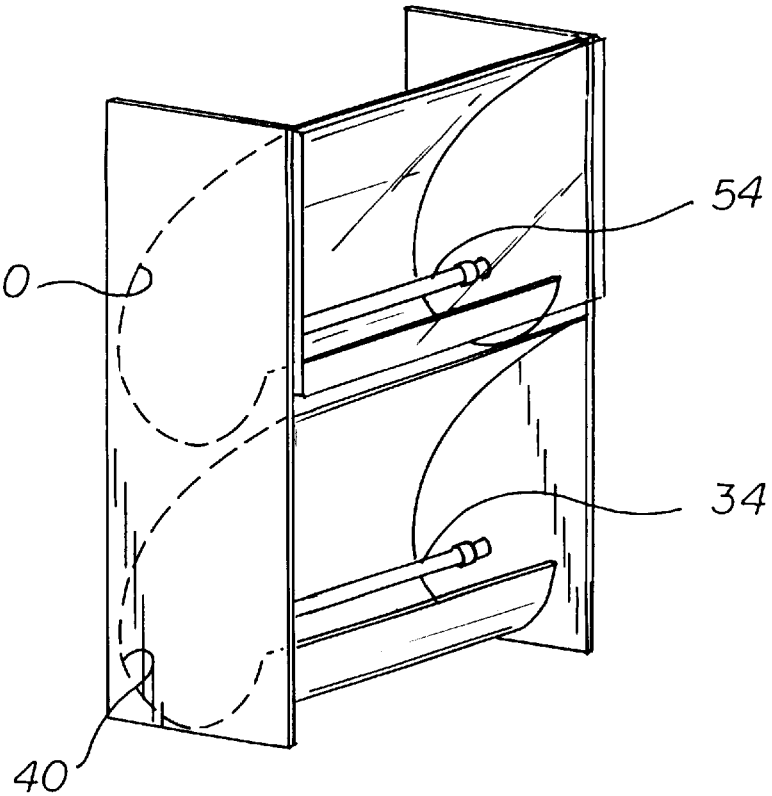
FIG 3
FIG 4
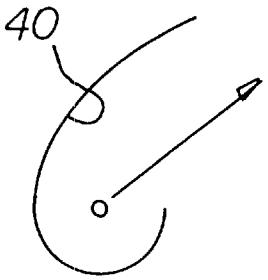
FIG 5
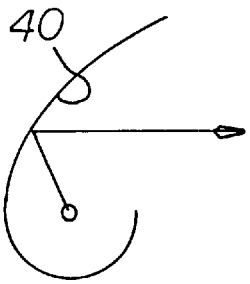
FIG 6
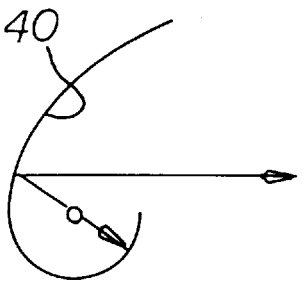

OBSTRUCTION LIGHTING SYSTEM

BACKGROUND OF THE INVENTION

1. Field of the Invention

The present invention relates to an obstruction lighting system and more particularly pertains to emitting a dual high intensity light with essentially no downward component.

2. Description of the Prior Art

The Federal Aviation Administration requires that obstructions to aircraft, such as towers, cables, tall buildings, and the like be fitted with elements to render them highly visible to approaching aircraft. Of these elements, there exists a requirement for a high intensity flashing light system to be placed in accordance with a set plan at levels on structures higher than 500 feet above ground level. The high intensity lighting system normally incorporates a series of powerful xenon gas discharge lights providing coverage over a 360 azimuth around the obstruction and within a band of between about 3 and 7 degrees about the horizontal. A requirement also exists for light output cutoff at angles greater than 10 degrees below the horizontal to minimize annoying ground illumination. In addition, the lights must change their output characteristics for daytime, twilight, and night operation. Of particular interest is the dual obstruction lighting system that employs added red medium intensity lights to complement the high intensity lights in nighttime mode. In the present art, a system of high intensity lights, typically three lights per tier, employs red medium intensity beacons for operation in night mode. The red light, which is adequate for air operations, was introduced after it was found that some forms of life are sensitive to the white flashing strobe lights at night. There is thus a need to combine the high intensity white and red nighttime light in a single unit. The subject invention substantially fulfills that need.

The use of lighting systems of known designs and configurations is known in the prior art. More specifically, lighting systems of known designs and configurations previously devised and utilized for the purpose of lighting obstructions are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 4,236,193 to Brandt discloses lighting equipment. U.S. Pat. No. 4,985,814 to Lyons discloses a warning light with quadruple reflective surfaces. Lastly, U.S. Pat. No. 5,155,666 to Radford et al discloses a light beacon for marking tall obstructions.

While these devices fulfill their respective, particular objectives and requirements, the aforementioned patents do not describe an obstruction lighting system that allows emitting a dual high intensity light with essentially no downward component.

In this respect, the obstruction lighting system according to the present invention substantially departs from the conventional concepts and designs of the prior art, and in doing so provides an apparatus primarily developed for the purpose of emitting a dual high intensity light with essentially no downward component.

Therefore, it can be appreciated that there exists a continuing need for a new and improved obstruction lighting system which can be used for emitting a dual high intensity light with essentially no downward component. In this regard, the present invention substantially fulfills this need.

SUMMARY OF THE INVENTION

In view of the foregoing disadvantages inherent in the known types of lighting systems of known designs and configurations now present in the prior art, the present invention provides an improved obstruction lighting system. As such, the general purpose of the present invention, which will be described subsequently in greater detail, is to provide a new and improved obstruction lighting system and method which has all the advantages of the prior art and none of the disadvantages.

To attain this, the present invention essentially comprises a housing. The housing has a rear vertical plate with vertical edges and horizontal upper and lower edges. The housing also has upper and lower horizontal plates. The upper and lower horizontal plates extend forwardly from the horizontal edges. The housing also has reflective vertical side plates extending forward from the vertical edges coupling the upper and lower horizontal plates. The housing also has a cover parallel with the rear vertical plate. In this manner a chamber is defined. A lower light source is formed in a generally cylindrical configuration within the chamber. The lower light source has ends supported by the side plates. The lower light source is a powerful pulsed white xenon gas discharge light. The lower light source has an axis within a lower horizontal plane. A lower reflector is next provided. The lower reflector has ends supported by the side plates. The lower reflector includes a lower component in a semi-circular configuration with an axis of rotation coextensive with the axis of the lower light source. Upper edges terminate at the lower horizontal plane. The lower component has a forward edge adjacent to the cover and a rearward edge adjacent to the rear vertical plate. The lower reflector has an upper component extending upwardly and forwardly from the rearward edge of the lower component in a parabolic configuration. The upper component also has a terminal edge above and forwardly of the forward edge. An upper light source is located vertically displaced above and parallel with the lower light source. The upper light source is a powerful pulsed white xenon gas discharge light. The upper light source has an axis within an upper horizontal lane. An upper reflector is located vertically displaced above the lower reflector. The upper reflector has ends supported by the side plates. The upper reflector includes a lower component in a semi-circular configuration with an axis of rotation coextensive with the axis of the upper light source. The lower component also has upper edges terminating at the upper horizontal plane. The upper edges include a forward edge adjacent to the cover and a rearward edge adjacent to the rear vertical plate. The upper reflector has an upper component extending upwardly and forwardly from the rearward edge of the lower component in a parabolic configuration. The upper component also has a terminal edge forwardly of the forward edge. Lastly, a red filter is provided. The red filter is in contact with the cover. The red filter has side edges and an upper edge coextensive with the side edges and upper edge of the cover end with a lower edge adjacent to the upper most extent of the lower reflector.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved obstruction lighting system which has all of the advantages of the prior art lighting systems of known designs and configurations and none of the disadvantages.

It is another object of the present invention to provide a new and improved obstruction lighting system which may be easily and efficiently manufactured and marketed.

It is further object of the present invention to provide a new and improved obstruction lighting system which is of durable and reliable constructions.

An even further object of the present invention is to provide a new and improved obstruction lighting system which is susceptible of a low cost of manufacture with regard to both materials and labor, and which accordingly is then susceptible of low prices of sale to the consuming public, thereby making such obstruction lighting system economically available to the buying public.

Even still another object of the present invention is to provide an obstruction lighting system for emitting a dual high intensity light with essentially no downward component.

Lastly, it is an object of the present invention to provide a new and improved lighting system including a housing with a rear plate and upper and lower plates extending forwardly and with side plates extending forward coupling the upper and lower plats and with a translucent cover essentially parallel with the rear plate to define a chamber there within. A light source is formed in a generally cylindrical configuration within the chamber. The light source has an axis within a horizontal plane. A reflector includes a lower component in a semi-circular configuration with an axis of rotation coextensive with the xis of the light source. The lower component also has upper ends terminating at the horizontal plane, a forward edge adjacent to the cover, and a rearward edge adjacent to the rear plate. The reflector has an upper component extending upwardly and forwardly from the rearward edge of the lower component in a parabolic configuration and terminating above and forwardly of the forward edge.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a perspective illustration of the side plates, light sources, and reflectors shown in FIGS. 1 and 2.

FIGS. 4, 5 and 6 illustrate the movement of light rays from the light source to exterior of the system with the reflector varying the directions of light flow.

The same reference numerals refer to the same parts throughout the various Figures.

DESCRIPTION OF THE PREFERRED EMBODIMENT

Figure 1:
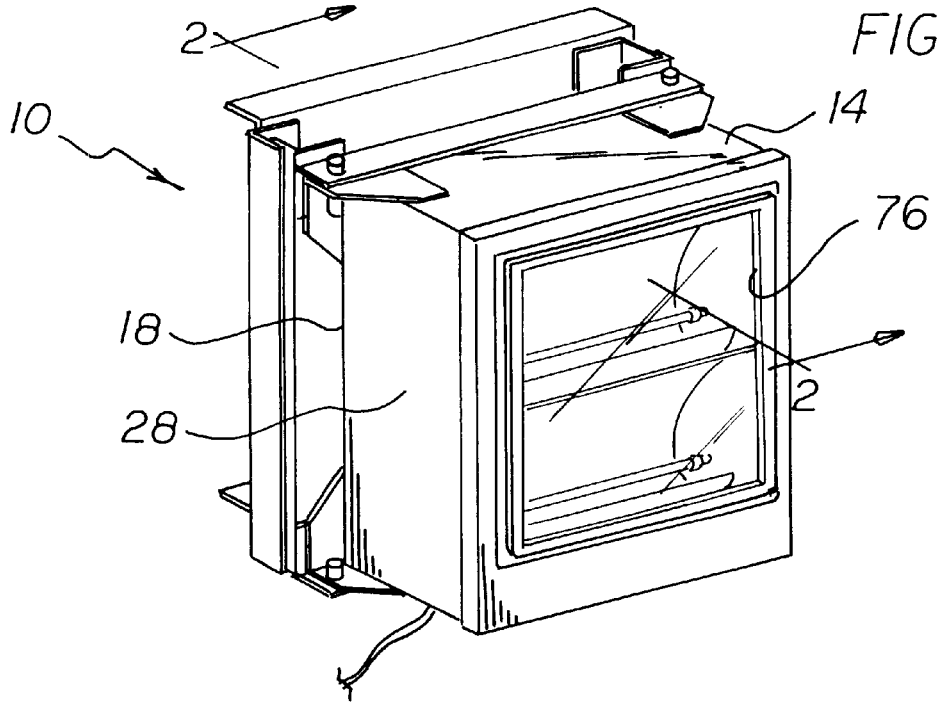
FIG. 1 is a perspective illustration of the new and improved obstruction lighting system constructed in accordance with the principles of the present invention.
Figure 2:
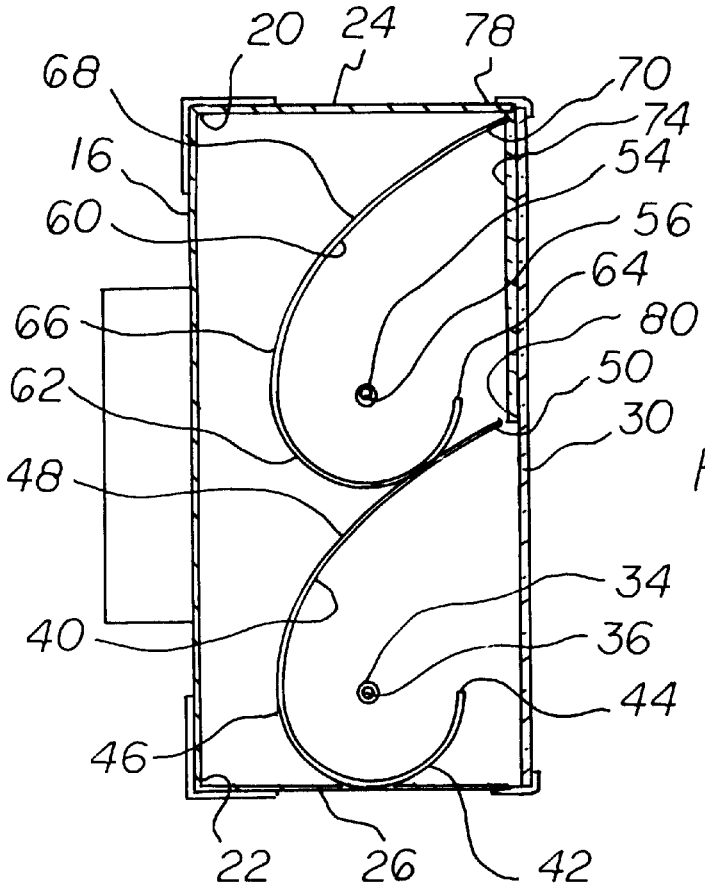
FIG. 2 is a cross sectional view taken along line 2—2 of FIG. 1.

With reference now to the drawings, and in particular to FIG. 1 thereof, the preferred embodiment of the new and improved obstruction lighting system embodying the principles and concepts of the present invention and generally designated by the reference numeral 10 will be described.

The present invention, the obstruction lighting system 10 is comprised of a plurality of components. Such components in their broadest context include a housing, a light source, and a reflector. Such components are individually configured and correlated with respect to each other so as to attain the desired objective.

First provided is a housing 14. The housing has a rear vertical plate 16 with vertical edges 18 and horizontal upper and lower edges 20, 22. The housing also has reflective upper and lower horizontal plates 24, 26. The upper and lower horizontal plates extend forwardly from the horizontal edges. The housing also has reflective vertical side plates 28 extending forward from the vertical edges coupling the upper and lower horizontal plates. The housing also has a preferably transparent, substantially transparent, or translucent cover 30 parallel with the rear vertical plate. In this manner a chamber is defined.

A lower light source 34 is formed in a generally cylindrical configuration within the chamber. The lower light source has ends supported by the side plates. The lower light source is a powerful pulsed white xenon gas discharge light. The lower light source has an axis 36 within a lower horizontal plane.

A lower reflector 40 is next provided. The lower reflector has ends supported by the side plates. The lower reflector includes a lower component 42 in a semi-circular configuration with an axis of rotation coextensive with the axis of the lower light source. Upper edges 44, 46 terminate at the lower horizontal plane. The lower component has a forward edge 44 adjacent to the cover and a rearward edge 46 adjacent to the rear vertical plate. The lower reflector has an upper component 48 extending upwardly and forwardly from the rearward edge of the lower component in a parabolic configuration. The upper component also has a terminal edge 50 above and forwardly of the forward edge.

An upper light source 54 is located vertically displaced above and parallel with the lower light source. The upper light source is a powerful pulsed white xenon gas discharge light. The upper light source has an axis 56 within an upper horizontal plane.

An upper reflector 60 is located vertically displaced above the lower reflector. The upper reflector has ends supported by the side plates. The upper reflector includes a lower component 62 in a semi-circular configuration with an axis of rotation coextensive with the axis of the upper light source. The lower component also has upper edges 64, 66 terminating at the upper horizontal plane. The forward edge 64 is adjacent to the cover. The rearward edge 66 is adjacent to the rear vertical plate. The upper reflector has an upper component 68 extending upwardly and forwardly from the rearward edge of the lower component in a parabolic configuration. The upper component also has a terminal edge 70 forwardly of the forward edge.

Lastly, a red filter 74 is provided. The red filter is in contact with the cover. The red filter has side edges 76 and an upper edge 78 coextensive with the side edges and the upper edge of the cover. The red filter also has a lower edge 80 adjacent to the uppermost extent of the reflector.

An alternate embodiment of the invention includes a second light source 84 formed as a plurality of red light emitting diodes (LED's) 86 to generate red light emergent in an angular distribution. A lens 88 is provided in front of the LED's. The lens is configured to have a first surface 90 to reduce the vertical angular deviation to between about 3 and 7 degrees. A second surface 92 is provided which integrates and spreads the horizontal light output to fill a requisite 120 degree angular distribution. The first surface is generally configured as a Fresnel lens. The second surface may be a lenticular array comprised of a plurality of extended cylindrical lenslets with radii and spacing devised to provide the appropriate integration and dispersion.

In an alternate embodiment, the dual high intensity obstruction light comprises a single xenon gas discharge tube affixed at the focal line of a paracyl reflector and has side reflectors. See FIGS. 6 and 7. In this embodiment, a plurality of red light emitting diodes (LED's) generate red light emergent in an angular distribution that is further modified by a lens. LED's typically emit light in a Gaussian power distribution which roughly forms a cone of half angle ranging from 15 degrees to 30 degrees. Red light output is required to attain 2,000 cd over a vertical distribution of 3 to 7 degrees and over a horizontal distribution of 120 degrees. A lens is devised to have a first surface which reduces the vertical angular deviation to 3 to 7 degrees, and a second surface, which integrates and spreads the horizontal light output to fill the requisite 120 degree angular distribution. The first surface is generally configured as a Fresnel lesns, although other lens types may be employed. The second surface may be a lenticular array comprised of a plurality of extended cylindrical lenslets with radii and spacing devised to provide the appropriate integration and dispersion.

It should be appreciated that the second light source of the alternate embodiment could readily be located either above or below the first light source as a function of he particular application. The same optional location of the two light sources is equally applicable to the primary embodiment.

The Federal Aviation Administration requires that obstructions to aircraft, such as towers, cables and tall buildings be fitted with elements to render these highly visible to approaching aircraft. Of these elements there exists a requirement for a high intensity flashing light system to be placed in accordance with a set plan at levels on structures higher than 500 feet above ground level. The high intensity lighting system incorporates a series of powerful xenon gas discharge lights providing coverage over a 360 azimuth around the obstruction and within a band 3 to 7 degrees about the horizontal. A requirement exits for light output cutoff at angles greater than 10 degrees below the horizontal to minimize annoying ground illumination. In addition, the lights must change their output characteristics for daytime, twilight, and night operation. Of particular interest is the dual obstruction lighting system that employs added red medium intensity lights to complement the high intensity lights in nighttime mode. In the present art, a system of high intensity lights, typically three lights per tier, employs red medium intensity beacons for operation in night mode. The red light, which is adequate for air operations, was introduced after it was found that some forms of life are sensitive to the white flashing strobe at night. There is a need to combine the high intensity white and red nighttime in a single uni and the subject invention substantially fulfills that need.

As described above, the present invention is a dual high intensity obstruction light which comprises a first pulsed gas discharge light source, a first reflector, a second pulsed gas discharge light source, a second reflector, and an optical filter disposed in a manner to intercept light emergent from the second reflector system and the second light source. The optical filter is devised to permit passage of light within a well-defined red spectral range. In the preferred system, reflective may be affixed to reflectors. In the alternative, each reflector may have a reflective sidewall affixed thereto. The angular disposition of reflective sidewalls may be adjusted to adjust the emergent light beamspread. The present invention is independent of any adjustment thereto.

Reflectors of the type disclosed ar known as a paracyl. A paracyl is a shape having a parabolic portion and a cylindrical portion joined along a common line. The parabolic portion is derived as an extrusion of a parabole having a focal length in a practical range. A two-inch focal length is brought into practice. The cylindrical portion si derived from a half circle having a radius equal to the focal length of the parabolic portion. In operation, light emitted from the source may follow a first ray path and leave the reflector without interacting with any surface, a second ray path which involves a single reflection from the parabolic portion, or a third ray path which involves a first reflection from the cylindrical portion and a second reflection from the parabolic portion. Compare FIGS. 4, 5 and 6. Note that light reflected from the cylindrical portion follows a path through its origin, or nearly so, therefore this light may be treated as emanating from the source. In essence, the paracyl reflector is substantially equivalent to a full parabolic trough reflector except that cylindrical portion of the paracyl both cuts off and renders usable any light which would take any of an unlimited number of paths below a horizontal plane. Only three paths are depicted, however, the entire region where light is intercepted by the cylindrical reflectors is obscured. The horizontal plane of this discussion includes the centerline of the source and the optical maximum of the parabolic portion established with the source centered upon the focal line of the reflector portion, and furthermore, any other plane substantially parallel to the plane so established. The cylindrical portion as shown is a half cylinder, however, sections less than a half cylinder may be used to provide some illumination in regions below the horizontal plane. Also, one or more holes or slots may be introduced in the cylindrical portion to illuminate regions below horizontal as desired. A primary advantage in employing the paracyl is the ability to obtain substantially the same optical output as the full parabolic trough reflector in a smaller package. Stacking two reflectors as shown in FIG. 1 results in an overall size for a light employing two independent sources, only one focal length larger in a vertical direction than a single sourced full parabolic trough reflector. In this manner, the dual high intensity obstruction light will exhibit compact and lightweight never before experienced in the obstruction lighting field.

The optical filter is substantially transparent to red light in the FAA/ICAO spectral boundaries y=0.980−x; y=0.335; and x+y+z=1 (CIE chromaticity diagram). The filter may comprise a single glass plate, a laminar assembly of glass and plastic plates, or a single plastic plate. In operation the filter will be exposed to relatively high temperatures (300° F.) and strong UV light from the source, because the source generally comprises a fused silica enveloped xenon gas discharge tube depositing approximately 200 W to 250 W of heat within reflector free space. Also the source is right in blue-green light that is absorbed by the filter and converted into additional heat. It is unlikely that a single plastic plate will survive, however, glass plates and laminates are commonly used in similar applications.

The dual high intensity obstruction light also includes a durable housing, an electrical power converter/control/monitoring assembly and mounting hardware. See FIG. 3.

Figure 7:
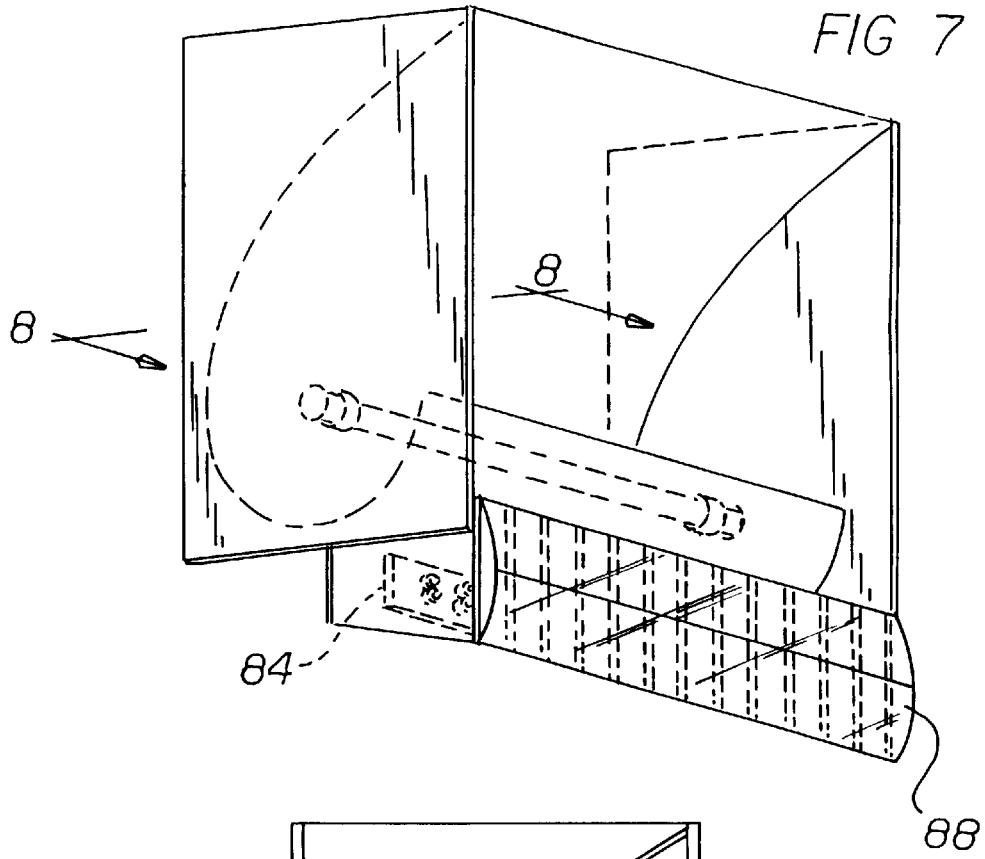
FIG. 7 is a perspective illustration similar to FIG. 3 but illustrating an alternate embodiment of the invention.
Figure 8:
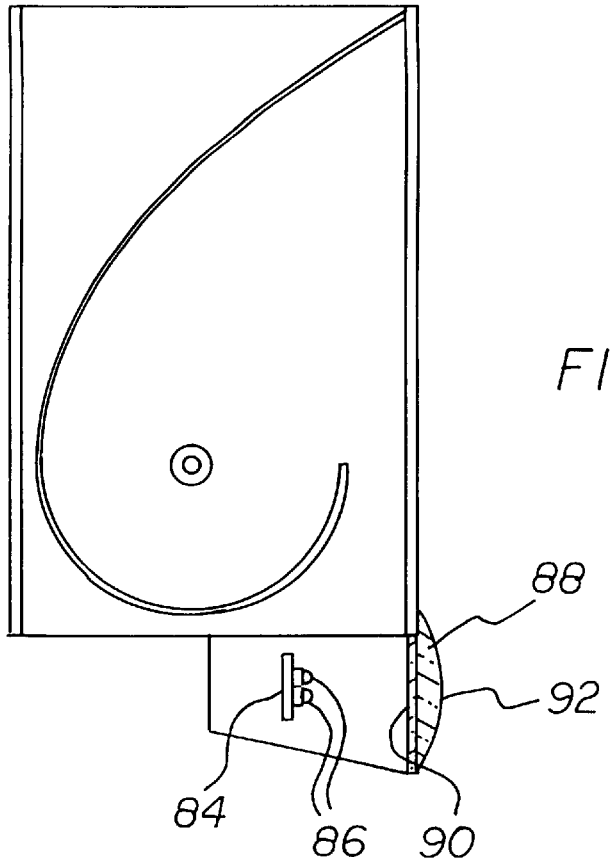
FIG. 8 is a cross sectional view taken alone line 8—8 of FIG. 7.

An alternate embodiment of the invention is shown in FIGS. 7 and 8. The dual high intensity obstruction light comprises above a single xenon gas discharge tube affixed at the focal line of a paracyl reflector and has side reflectors. In this embodiment, a plurality of red light emitting diodes (LED's) are located in the lower extent and generate red light emergent in an angular distribution that is further modified by a lens. LED's typically emit light in a Gaussian power distribution which roughly forms a cone of half angle ranging from 15 degrees to 30 degrees. Red light output is required to attain 2,000 cd over a vertical distribution of between about 3 and 7 degrees and over a horizontal distribution of 120 degrees. The lens is devised to have a first surface which reduces the vertical angular deviation to 3 to 7 degrees, and a second surface, which integrates and spreads the horizontal light output to fill the requisite 120 degree angular distribution. The first surface is generally configured as a Fresnel lens, although other lens types may be employed. The second surface is preferably a lenticular array comprised of a plurality of extended cylindrical lenslets with radii and spacing devised to provide the appropriate integration and dispersion.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. An obstruction lighting system for emitting a dual high intensity light with essentially no downward component comprising, in combination:

a housing having a rear vertical plate with vertical edges and horizontal upper and lower edges and upper and lower horizontal plates extending forwardly from the horizontal edges and with reflective vertical side plates extending forward from the vertical edges coupling the upper and lower horizontal plates and with a cover parallel with the rear vertical plate to define a chamber there within;

a lower light source in a generally cylindrical configuration within the chamber and having ends supported by the side plates, the lower light source being a powerful pulsed white xenon gas discharge light, the lower light source having an axis within a lower horizontal lane;

a lower reflector having ends supported by the side plates and including a lower component in a semi-circular configuration with an axis of rotation coextensive with the axis of the lower light source and with upper edges terminating at the lower horizontal plane and with a forward edge adjacent to the cover and a rearward edge adjacent to the rear vertical plate, the lower reflector having an upper component extending upwardly and forwardly from the rearward edge of the lower component in a parabolic configuration and with a terminal edge above and forwardly of the forward edge;

an upper light source located vertically displaced above and parallel with the lower light source, the upper light source being a powerful pulsed white xenon gas discharge light, the upper light source having an axis within an upper horizontal plane;

an upper reflector located vertically displaced above the lower reflector, the upper reflector having ends supported by the side plates and including a lower component in a semi-circular configuration with an axis of rotation coextensive with the axis of the upper light source and with upper edges terminating at the upper horizontal plane and with a forward edge adjacent to the cover and a rearward edge adjacent to the rear vertical plate, the upper reflector having an upper component extending upwardly and forwardly from the rearward edge of the lower component in a parabolic configuration and with a terminal edge forwardly of the forward edge; and a red filter in contact with the cover having side edges and an upper edge coextensive with the side edges and top edge of the cover and with a lower edge adjacent to the upper most extent of the lower reflector.

2. A lighting system comprising:

a housing having a rear plate and upper and lower plates extending forwardly and with side plates extending forward coupling the upper and lower plates and with a cover essentially parallel with the rear plate to define a chamber there within;

a light source in a generally cylindrical configuration within the chamber, the light source having an axis within a horizontal plane; and a reflector including a lower component in a semi-circular configuration with an axis of rotation coextensive with the axis of the light source and with upper ends terminating at the horizontal plane and with a forward edge adjacent to the cover and a rearward edge adjacent to the rear plate, the reflector having an upper component extending upwardly and forwardly from the rearward edge of the lower component in a parabolic configuration and terminating above and forwardly of the forward edge.

3. The system as set forth in claim 2 and further including:

a second light source located vertically displaced with respect to the first mentioned light source, and second light source having an axis within a second horizontal plane; and a second reflector located vertically displaced with respect to the first mentioned reflector, the second reflector including a lower component in a semi-circular configuration with an axis of rotation coextensive with the axis of the second light source and with upper ends terminating at the second horizontal plane and with a forward edge adjacent to the cover and a rearward edge adjacent to the rear vertical plate, the second reflector having an upper component extending upwardly and forwardly from the rearward edge of the lower component in a parabolic configuration and terminating forwardly of the forward edge.

4. The system as set forth in claim 3 and further including a filter in contact with the cover having side edges and a lower edge coextensive with the side edges and upper edge of the cover and with a lower edge adjacent to the upper most extent of the first mentioned reflector.

5. The system as set forth in claim 2 and further including a second light source formed as a plurality of red light emitting diodes (LED's) to generate red light emergent in an angular distribution with a lens in front of the LED's, the lens being configured to have a first surface to reduce the vertical deviation between about 3 to 7 degrees with a second surface which integrates and spreads the horizontal light output to fill a requisite 120 degree angular distribution, the first surface being generally configured as a Fresnel lens, the second surface being generally configured as a lenticular array comprised of a plurality of extended cylindrical lenslets with radii and spacing devised to provide the appropriate integration and dispersion.

6. The system as set forth in claim 2 and further including a second light source formed as a plurality of red light emitting diodes (LED's) to generate red light emergent in an angular distribution with a lens in front of the LED's, the lens being configured to have a first surface to reduce the vertical deviation between about 3 to 7 degrees with a second surface which integrates and spreads the horizontal light output to fill a requisite 90 degree angular distribution, the first surface being generally configured as a Fresnel lens, the second surface being generally configured as a lenticular array comprised of a plurality of extended cylindrical lenslets with radii and spacing devised to provide the appropriate integration and dispersion.

* * * * *